United States Patent [19]

Sato et al.

[11] Patent Number: 4,830,522

[45] Date of Patent: May 16, 1989

[54] ELECTRONIC HAND LABELER WITH THERMAL PRINTER AND PLURAL CUTTERS

[75] Inventors: Yo Sato, Tokyo; Tadao Kashiwaba, Iwate, both of Japan

[73] Assignee: Kabushiki Kaisha Sato, Japan

[21] Appl. No.: 60,328

[22] Filed: Jun. 10, 1987

Related U.S. Application Data

[63] Continuation-in-part of Ser. No. 46,249, May 5, 1987, abandoned, which is a continuation-in-part of Ser. No. 828,070, Feb. 10, 1986, abandoned.

[30] Foreign Application Priority Data

Feb. 13, 1985 [JP] Japan ..... 60-24455
Jun. 10, 1986 [JP] Japan ..... 61-132712

[51] Int. Cl.[4] ..... B41K 5/02

[52] U.S. Cl. ..... 400/120; 400/70; 400/88; 400/618; 400/621; 400/691; 101/288

[58] Field of Search ..... 101/288, 291, 292; 400/120, 88, 691, 618, 621; 156/384

[56] References Cited

U.S. PATENT DOCUMENTS 2,664,988 1/1954 Metzner ..... 400/618
4,176,603 12/1979 Sato ..... 101/288 X
4,257,327 3/1981 Sato ..... 101/288
4,432,830 2/1984 Jue ..... 101/288 X
4,561,926 12/1985 Hamisch, Jr. et al. ..... 101/288 X

FOREIGN PATENT DOCUMENTS 0000657 2/1979 European Pat. Off. .
0126899 12/1984 European Pat. Off. .
240470 11/1985 Japan ..... 400/88

OTHER PUBLICATIONS

Yarbrough, "Personal Computer Enclosure", IBM Technical Disclosure Bulletin, vol. 27, No. 6, Nov. 1984, pp. 3630–3631.

*Primary Examiner*—Clifford D. Crowder
*Attorney, Agent, or Firm*—Ostrolenk, Faber, Gerb & Soffen

[57] ABSTRACT

A versatile hand held thermal printer has a hinged bottom cover which can be opened to provide easier access and loading of a roll of labels into the thermal printer. In a first mode of operation, printed labels emerge through the front of the label printer one by one, peeled from their backing sheet and ready for being applied directly to an article. In a second mode, the labels emerge attached to a strip of backing sheet to provide a plurality of printed labels on a strip. The hinged bottom cover of the labeler has cutters both at the front and at the rear thereof to enable a length of the strip of labels issuing at the front or a length of the backing sheet at the rear to be easily cut off. In a further embodiment, the thermal printer is positioned on a stand and the stand further supports a control unit into which information that is to be printed on the labels is inputted. The stand further includes an upright reel supporter on which a roll or web of thermal tag strips can be located. The thermal tag strip is guided into the printer unit for imprinting information thereon.

16 Claims, 12 Drawing Sheets

FIG. 5
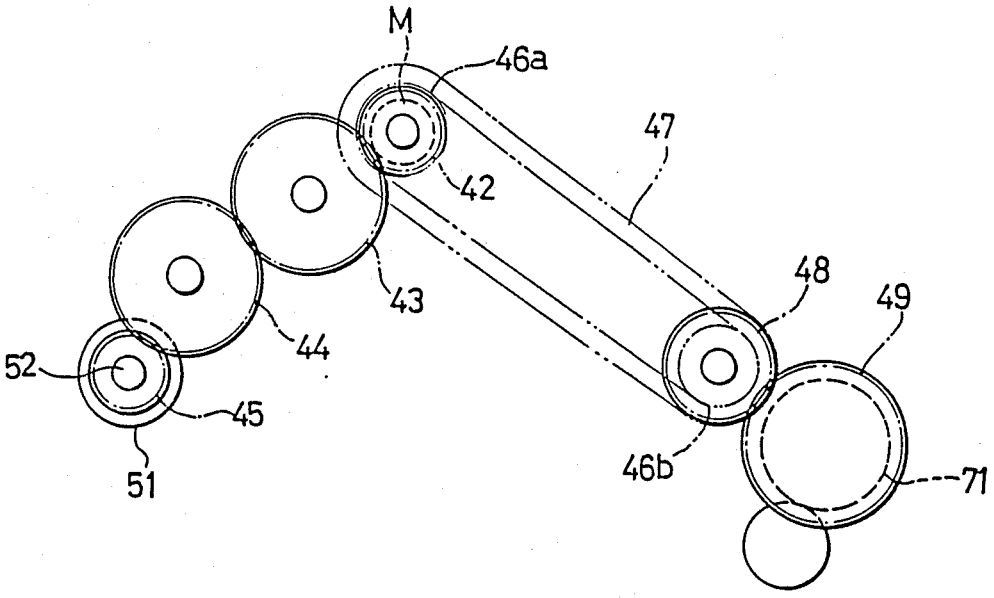
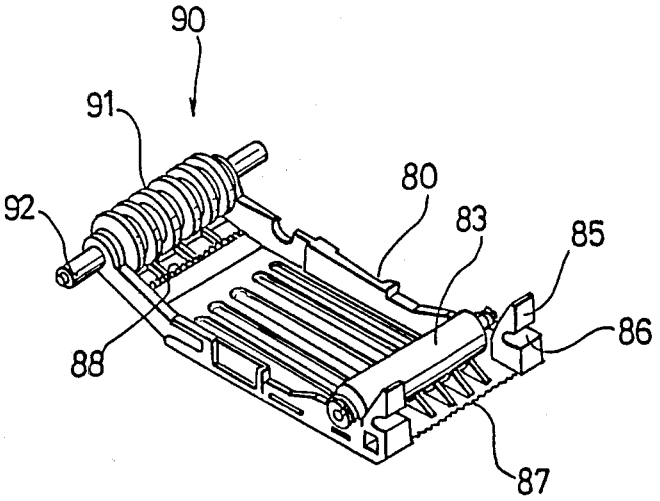
FIG. 7

ELECTRONIC HAND LABELER WITH THERMAL PRINTER AND PLURAL CUTTERS

BACKGROUND OF THE INVENTION

This is a Continuation-in-part application of Ser. No. 046,249, filed on May 5, 1987 which in turn is a Continuation-in-part application of Ser. No. 828,070, filed on Feb. 10, 1986, both now abandoned.

This invention relates generally to a thermal printer for printing and dispensing labels and more specifically to both a desktop version and a hand held version of such thermal printers. Both types of label printers, or labelers for short, include the means for selectively removing printed labels from their backing sheet or leaving them on the backing sheet. The hand held labeler is in particular suitable to be easily carried about in one hand and operated for marking prices on merchandise and printing labels with price bar codes. The hand held labeler can be interfaced to an optical reader or the like to read the price bar code and as such it may be used, for example, at checkout counters.

Stationary, desktop-type printers are often used for printing labels and for applying the labels to merchandise. Such desktop printers are however large and heavy and require that the merchandise be brought to the printer. This and the cumbersome way in which the labels are attached to the merchandise makes the overall process of printing and applying labels inefficient.

Portable label printing and attaching devices ("hand labelers") are often used in place of the bulkier desktop printers However, hand labelers are not as sophisticated as desktop printers and are more likely to produce errors in handling data such as prices, check sum digits and the like. They also produce an inferior printing quality, which is of concern particularly with respect to bar code printing where precision in printing is important.

Accordingly, the present invention provides an electronic hand labeler with a thermal print head which incorporates the more desirable features of both desktop printers and hand labelers to thus provide good overall operational efficiency and high precision in printing.

Conventional hand labelers employ rollers which engage of pull a strip-like backing sheet to which a plurality of thermal labels are detachably adhered. A motor operates the rollers so that the strip-like backing sheet is forcibly paid out at the rear of a main unit.

This ordinary labeler dispenses labels on a "label-by-label" basis. In label-by-label feeding, a plurality of thermally-printed labels are detachably adhered to a slip-like backing sheet. After being printed, the labels are peeled off the backing sheet by a bending pin which is located toward the front of the main unit of the labeler. At the bending pin, the travel direction of the backing sheet bends sharply rearwardly which detaches the labels from the backing sheet and the labels come to rest on a label applicator located at the front of the main unit. The peeled labels are then affixed to merchandise by a label affixing means.

A labeler which provides only a label-by-label feeding capability is not sufficiently versatile. For example, a salesperson, stationed at a sales counter in a supermarket, or one who delivers merchandise, usually requires a large quantity of preprinted labels which are still attached to their backing sheet. It is intended that the salesperson or deliverer will peel the labels manually, for example, by fingertip or the like, and apply them to the merchandise, without using any tool. The term "label strip" herein refers to such printed labels which are delivered out of the labeler still adhered to their backing sheet.

Because of the disadvantage of having only label-by-label capability, some labelers are designed to accept a separate attachment piece which is attachable to the labeler to provide "label strip" feeding capability. The fitting and removal of such an attachment is, however, cumbersome.

SUMMARY OF THE INVENTION

It is an object of the present invention to provide an electronic, thermal print head type, hand labeler which is self contained and operable for printing and applying labels and which requires no special attachments for performing those functions.

It is another object of the invention to provide the hand labeler with a capability of supplying both single peeled labels and continuous label strips.

It is a further object of the invention to enable the labeler to print information on a tag strip, using the technique that is employed for producing continuous label strips.

It is also an object of the present invention to provide a handy desktop thermal printer for individual use which is freely portable and easily locatable on any available surface.

It is another object of the present invention to provide such a desktop thermal printer which is capable of both a first mode of operation wherein the printer supplies peeled printed labels ready to be affixed to objects and a second mode of operation where the printed labels, still attached to their backing sheet, are supplied from the printer.

The present invention attains the foregoing objects with a thermal hand labeler comprised of a platen roller which is juxtaposed to a thermal print head to enable paying out discrete peeled thermal labels and continuous strips of labels or tags. A transport roller located to the rear of the platen roller pulls the strip-like backing sheet around a bending pin for causing the labels to peel off the backing sheet. If desired, the backing sheet may instead be guided directly to the front of and then out of the labeler, to provide label strips, rather than peeled labels. Both the platen roller and the transport roller are driven by a motor in a manner which enables the labels to be supplied either one by one or as continuous label strips. A bottom cover for the labeler is hingedly mounted and readily openable to enable easy loading of a web or roll of labels into the labeler.

With respect to the desktop thermal printer, the present invention attains the foregoing objects by providing a desktop thermal printer comprising a main unit having a passage or guide path for passage therethrough of a continuous label strip consisting of discrete thermosensitive labels which are detachably attached to an elongate continuous backing sheet. The main unit includes a flat bottom surface, permitting it to rest on any selected flat surface. The printer further includes a retaining means for supporting a roll of labels on a strip or backing sheet; label detecting means; label transfer means which includes a stepping motor and a sheet drive roller; thermal printing means including a thermal printing head and a platen roller for printing characters, marks or the like on the thermosensitive labels; label peeling means; data input means; data display means and various control means for controlling the operation of the aforesaid various means, the sheet drive roller and the platen roller.

The desktop thermal printer according to the present invention is small in size and easily carried from place to place. It can be used for printing labels while being located on any available flat surface. It can print and feed the labels in either peeled or unpeeled form, making it usable as a wide range output device applicable in various fields.

Other features and advantages of the present invention will become apparent from the following description of the invention which refers to the accompanying drawings.

BRIEF DESCRIPTION OF THE DRAWINGS

FIG. 5 shows the drive transmission for the platen roller and the traction/transport roller of the printer-labeler unit.

FIG. 7 is a perspective view of a label cutting device which is provided on the bottom cover of the printer-labeler unit.

DETAILED DESCRIPTION OF THE PREFERRED EMBODIMENTS

The text which follows describes a first version of the invention which pertains to a hand held labeler and a second version which concerns a desktop model of a labeler according to the present invention. Two embodiments of the hand held labeler are presented by reference to FIGS. 1–9. The single embodiment of the desktop labeler of the present invention refers to FIGS. 10–13.

Figure 1:
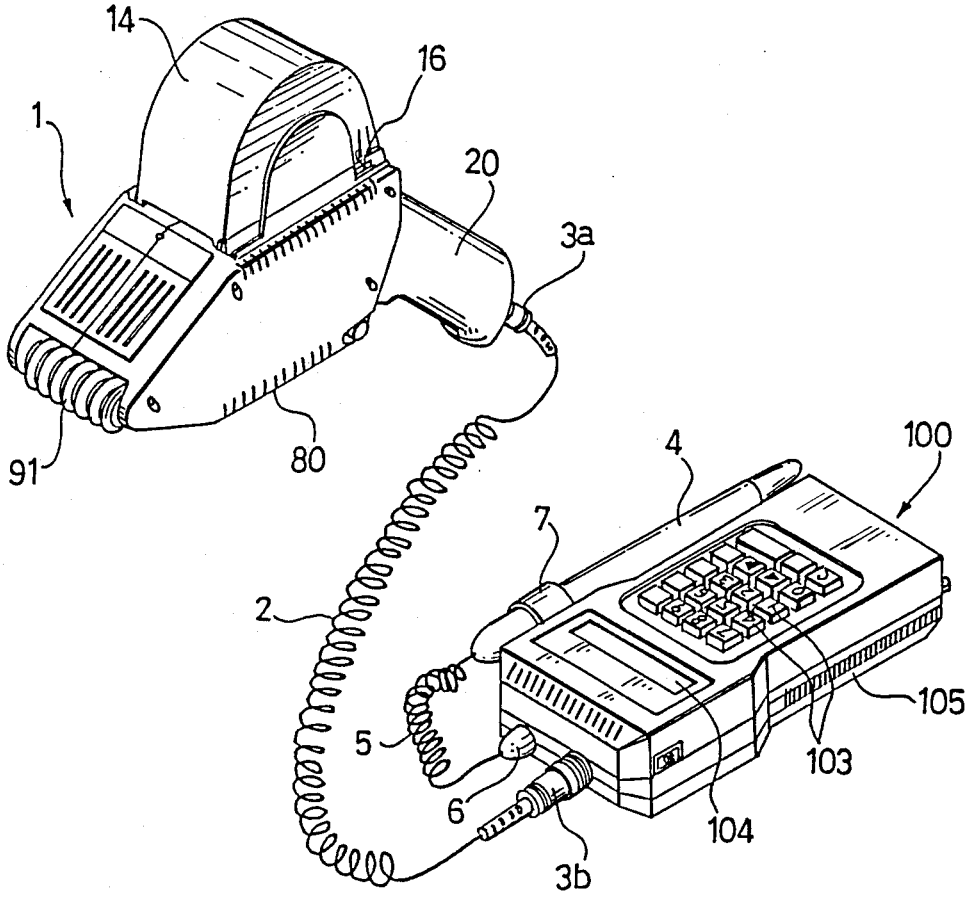
FIG. 1 is a perspective view of a printer-labeler unit, a control unit and a pen scanner setup according to a first embodiment of the portable labeler of the invention.

Referring to FIG. 1, an electronic hand labeler of the present invention includes a printer-labeler unit 1 that is suited for single-hand operation; a separate, self-contained, control unit 100 which is connected by a cable 2 to printer-labeler unit 1; and a pen scanner 4 which is connected to control unit 100 by cable 5. All of these are portable and may be carried in a person's pocket or hung on his belt.

Control unit 100 includes keyboard 103, display 104, batteries 105, and a holder 7 for holding pen scanner 4. Reference numerals **3*a*, 3*b* and 6** denote cable plugs.

Figure 2:
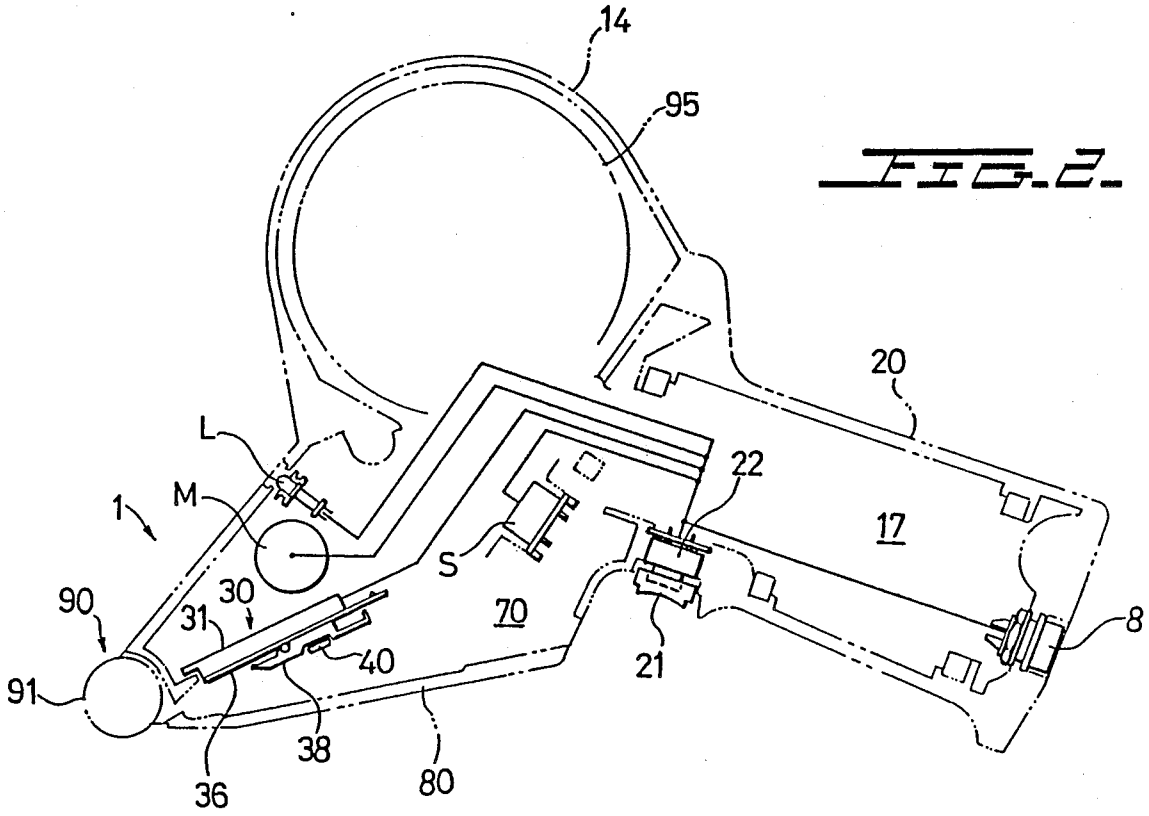
FIG. 2 is a side view of the printer-labeler unit shown in FIG. 1.
Figure 3A:
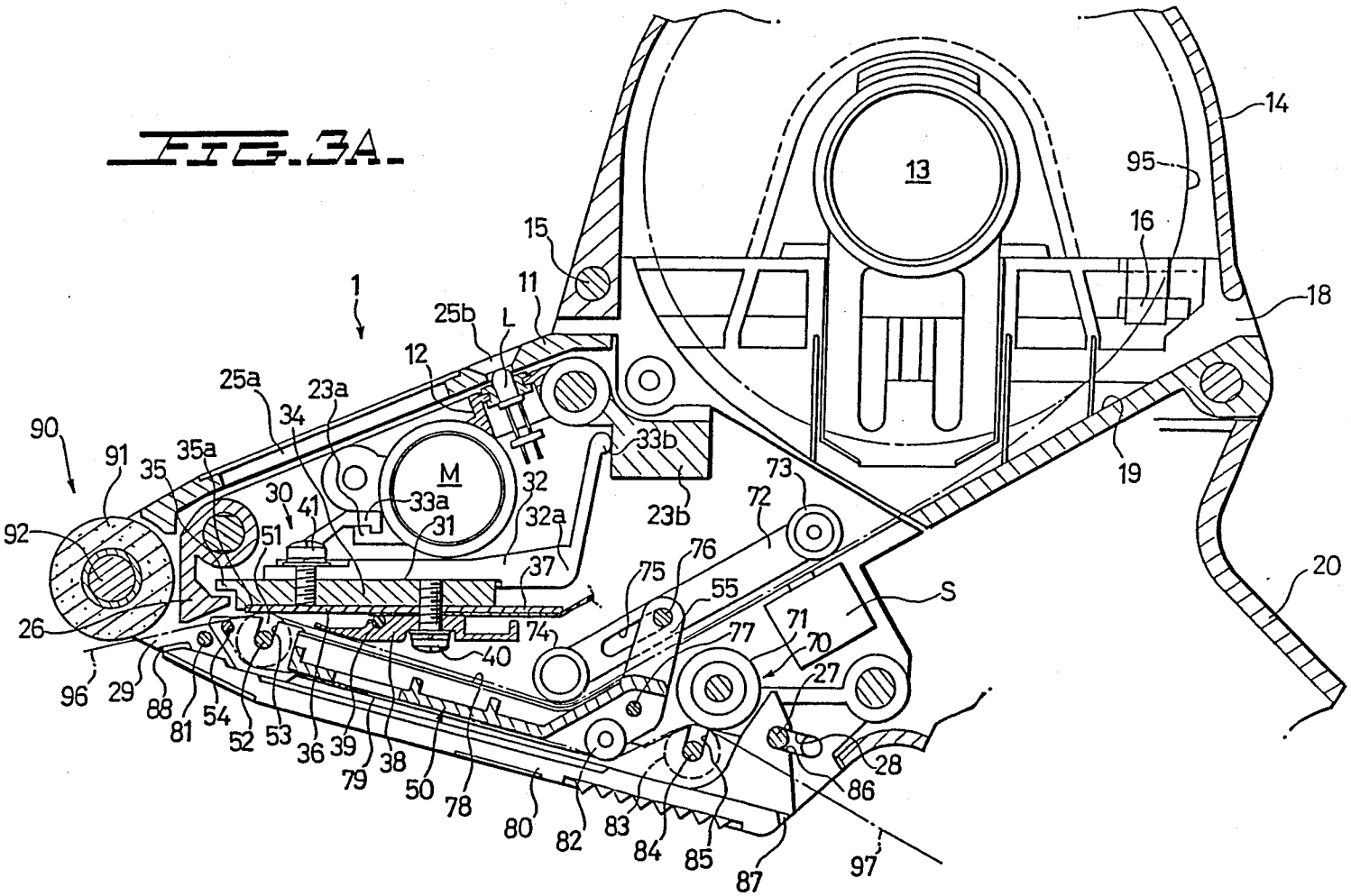
FIG. 3A is an enlarged cross-sectional view of the main parts of the printer-labeler unit.
Figure 3B:
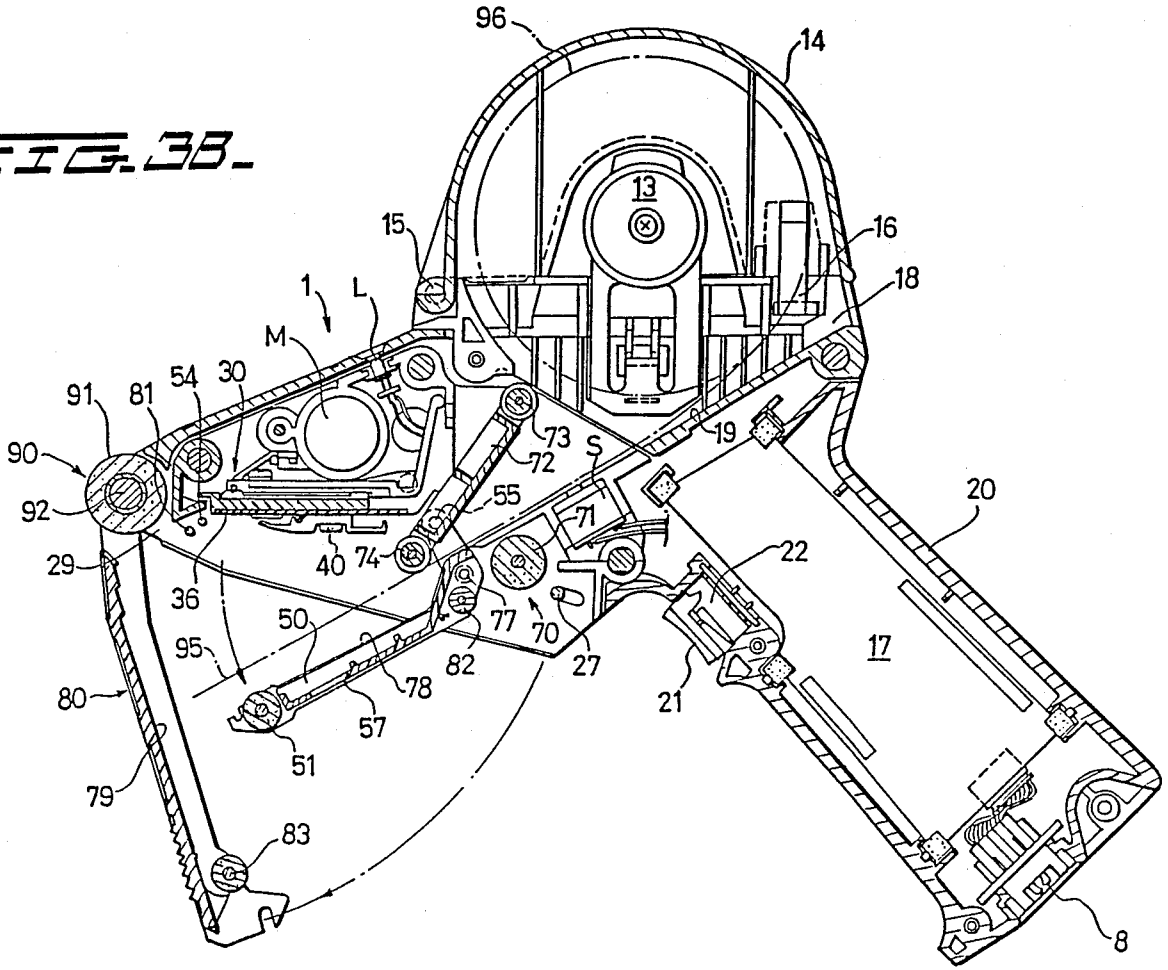
FIG. 3B shows the label routing, through the labeler of FIG. 1, with the printer-labeler unit cover and platen arm in an open position.

Referring to FIGS. 2, 3A and 3B, a label web holder 13 for holding a continuous roll 95 of thermal-labels is provided on the upper portion of an outer frame 11 of printer-labeler unit 1. A grip 20 which allows the unit to be gripped and operated single-handedly is at the rear of holder 13. Within the interior of outer frame 11, which defines a labeler housing, is disposed a label printing and dispensing mechanism which includes a thermal printing device 30, a label transporting device 70 and a label applicator 90. At label holder 13, an approximately semicircular label case 14, which encases the label roll 95, is affixed to a spindle 15 which is located at the forward part of outer frame 11. Case 14 is easily openable around spindle 15 toward the front of the labeler. In its illustrated closed position, the case 14 is engaged by an engaging portion 16.

As seen in FIGS. 1 and 2, grip 20 houses a microswitch 22 which is operated by a push button 21. Microswitch 22 is detachably connected to connector 8 and from there to the plug **3*a* of cable 2. That cable is connected to batteries 105 disposed inside control unit 100. Microswitch 22 is also connected to thermal print head 36 of a thermal printing device 30, to motor M of a label transport device 70**, to diode type emission reflection lamp L and to reflection type sensor S.

Figure 6:
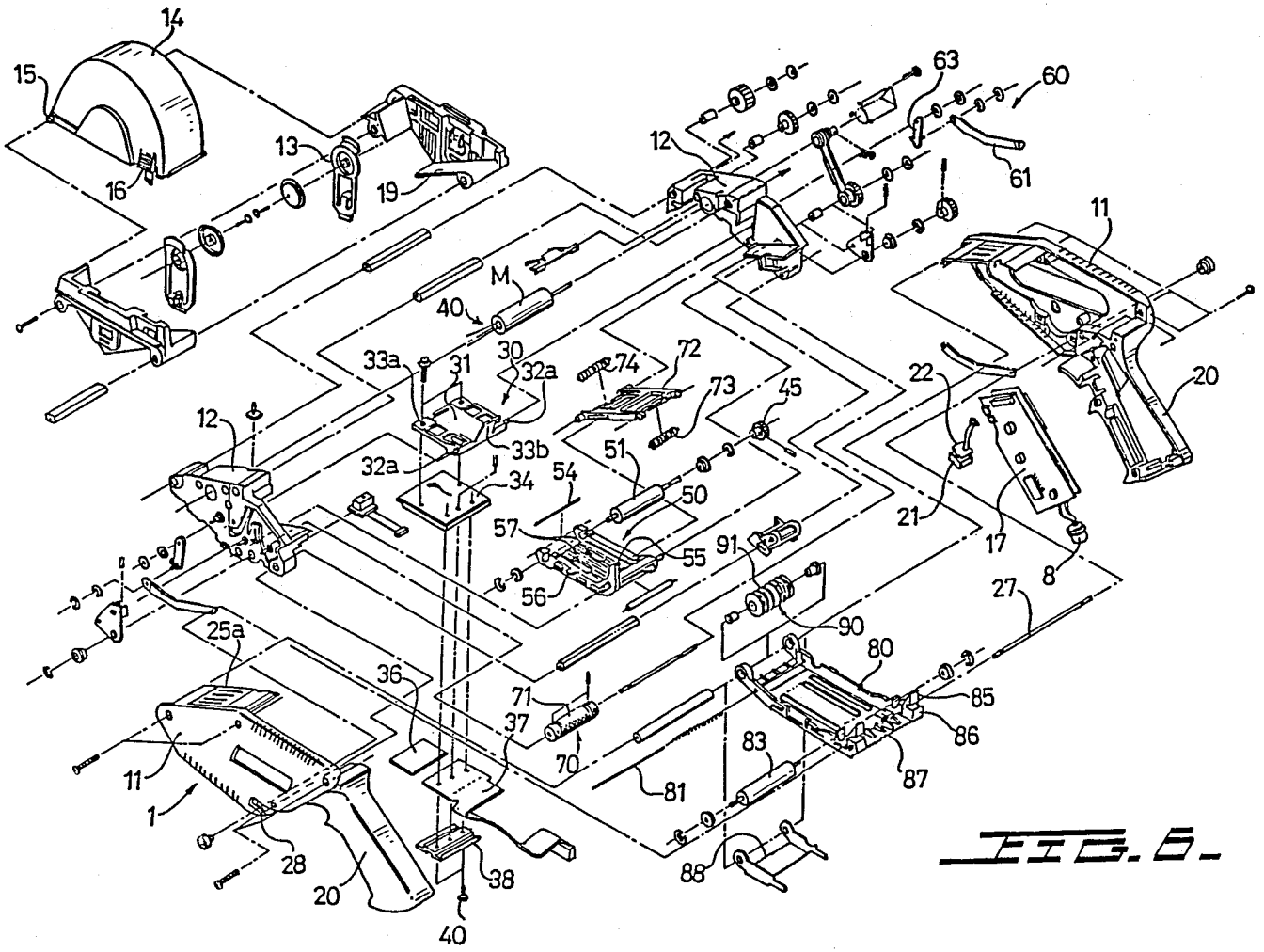
FIG. 6 is an exploded perspective view of the printer-labeler unit.

The thermal printing device 30, as seen in FIGS. 3A, 3B and 6, is attached to an inner frame 12 provided at one portion of outer frame 11. Device 30 is comprised of a combination of a thermal unit 31 and a platen roller 51. More specifically, a heat radiation member 34 of a unit baseplate 32 is attached to the thermal unit 31 by a fixing screw 41. A thermal print head 36 is attached, by means of a thermal print head retainer plate 38, an O-ring 39 and a fixing screw 40, to the forward portion of heat radiation member 34. A flexible ribbon cable 37 is connected to thermal print head 36 and extends toward the rear thereof, and O-ring 39 is arranged at the join portion to provide a secure attachment. The ribbon cable 37 is wired to connector 8 via the microswitch 22, the wiring of ribbon cable 37 being effected at circuit board 17 which is located in grip 20.

The entire thermal unit 31 is secured to inner frame 12 by a pair of mounting bosses **32*a* which are provided on baseplate 32 and which engage socket portions in inner frame 12 in a manner which enables the front part of thermal unit 31 to swing. A stepped portion 35*a* formed at the front edge of heat radiation member 34 is spaced from and opposes main unit fixing portion 26**.

Two resilient engaging members **33*a* and 33*b* are disposed on the upper region of thermal unit 31. Engaging members 33*a* and 33*b* are constructed of a springy material and are attached to the baseplate 32. The free ends of engaging members 33*a* and 33*b* abut, respectively, motor fixing portion 23*a* and unit fixing portion 23*b*, in inner frame 12**.

Thermal print head 36 is positioned at the lower front surface portion of thermal unit 31 and is aligned into position with the help of an alignment step portion **35*a* formed on heat radiation member 34. Thus, only when the front edge of the thermal print head 36 fits into step portion 35*a* is the thermal print head 36 resiliently urged into its correct position. The above arrangement assures correct alignment of thermal print head 36 relative to platen roller 51 which is located opposite the head. Through-holes 25***a* carry away heat generated by motor M and hole 25*b* provides a window for lamp L.

The platen roller 51 is normally urged against the thermal print head 36 by the resilience of engaging members 33*a* and 33*b*, and that roller is rotatably mounted on platen arm 50. Platen roller 51 rotates on spindle 52. The ends of the spindle are housed in retainer portions 53 consisting of cutouts in the frame of platen arm 50. Motor M drives platen roller 51. Information is imprinted on thermal labels 96 as platen roller 51 both moves and presses the labels against thermal print head 36. At the tip of the platen roller 51, backing sheet 97 bends sharply around bending pin 54 to cause thermal labels 96 to peel off backing sheet 97. Platen arm 50 is supported on pivot 77 to pivot counterclockwise as seen in FIG. 3B.

A label retainer member 2, the movement of which is interlocked with the rotation of platen arm 50, is provided in the main unit. A coupling pin 76, disposed on coupling portion 55 and curving upwardly toward the back of platen arm 50, is fitted into a slot 75 in label retainer member 72. Moving together with platen arm 50, label retainer member 72 pivots about fixed guide roller 74 which is located at one end of the label retainer member 72, such that the movable guide roller 73 which is located at the other end on retainer member 72 is displaced away from the solid line toward the double-dot chain line. Therefore, guide rollers 73 and 74 which are ordinarily in contact with the inclined label guide passage surface 19, which is located below label holder 13, become separated from the label guide passage surface 19 to form a wide label insertion passage.

For pulling backing sheet 97 around bending pin 54, there is a label transport device 70 which includes traction roller 71 located near and generally below label retainer member 72. Traction roller 71 is driven by motor M. A pressure roller 83 is set inside lower casing 80 to exert a pressure on traction roller 71. As a result, the strip-like backing sheet 97 is held tightly between rollers 71 and 83 and is driven by the rotation of these rollers out through the rear of the main unit. The section of the backing sheet 97, which extends between traction roller 71 and bending pin 54, is therefore taut to provide reliable peeling of the thermal labels 96 from backing sheet 97.

Although roller 71 engages backing sheet 97 by friction, other pulling arrangements for pulling the backing sheet may be envisioned. One such alternate embodiment may include an engagement roller comprised of, for example, a rotating member having radially extending engaging pins along its circumference for engaging conveying holes or perforations provided in the backing sheet 97. Thus, rotation of the engagement roller will produce the desired driving of backing sheet 97.

The details of the mechanical interconnection of motor M to platen roller 51 and traction roller 71 are illustrated in FIG. 5. Thus, rotation of motor M is transmitted to platen roller 51 through rotation of motor gear wheel 42 whose rotation is in turn communicated via intermediate gear wheels 43 and 44 which mesh with a gear wheel 45 with which platen roller 51 is coaxially mounted. Traction roller 71 is also rotated by motor M because the motor is coupled thereto via belt 47 which is mounted on pulleys 46*a* and 46*b*. The belt 47 rotates gear wheel 48 which in turn rotates traction roller gear wheel 49 of traction roller 71.

It is desired that traction roller 71 be driven at a higher speed than platen roller 51. This is needed in order to apply extra traction to backing sheet 97 downstream of platen roller 51. Stated differently, the section of the backing sheet 97 between platen roller 51 and traction roller 71 must be taut to reliably separate labels 96 from backing sheet 97.

A bottom cover 80 to cover the bottom of the main unit is mounted to pivot about a spindle 92 which is part of label applicator roller 91. Thus bottom cover 80 is openable by being pivoted clockwise with respect to spindle 92. In its closed state, bottom cover 80 encloses an auxiliary peeling pin 81 which is located adjacent to bending pin 54 of platen arm 50. The other end of bottom cover 80 supports a pressure roller 83 which lies adjacent a backing-sheet guide roller 82. Pressure roller 83 is supported on a spindle 84 which is provided with ends which fit into retaining slots 85 which are provided in the frame of bottom cover 80.

Insets 86 which are also located at the rear end of bottom cover 80 accommodate a resiliently-urged set pin 27 that is fitted into guide slot 28 which is formed in outer frame 11.

Figure 4:
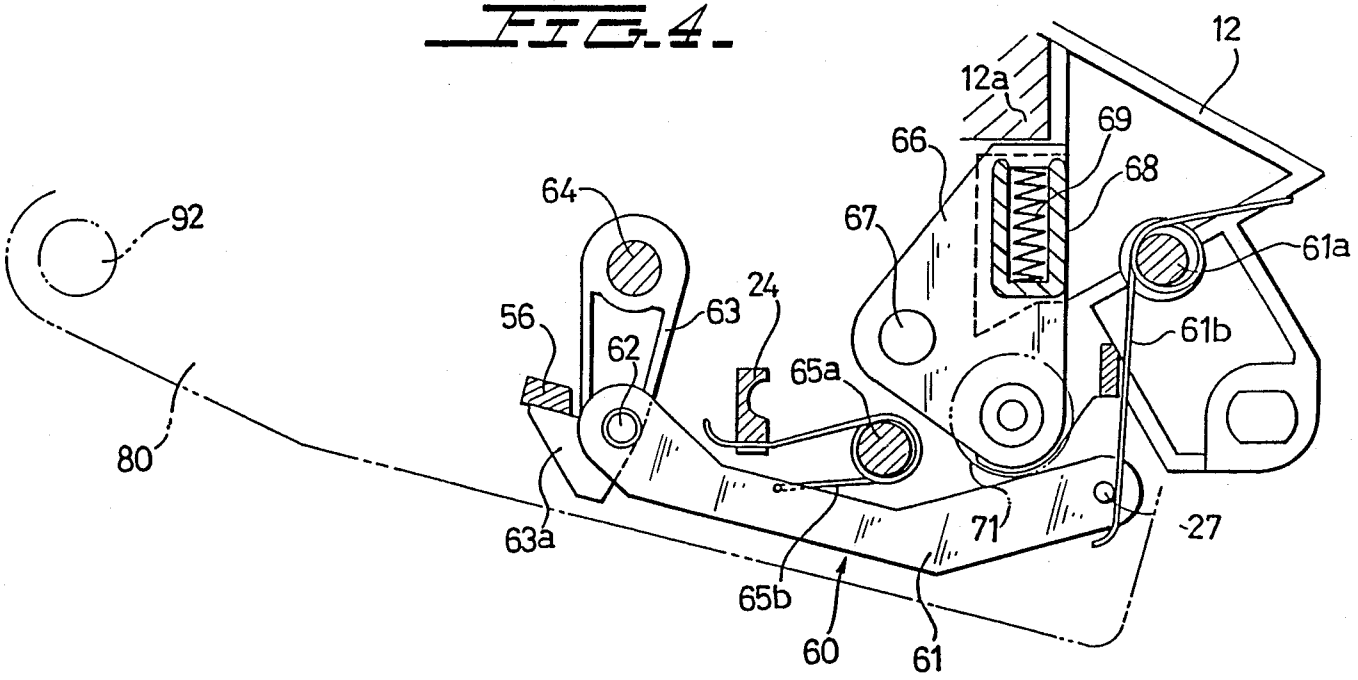
FIG. 4 is a partially cutaway side view of the platen arm retaining device of the printer-labeler unit.

Set pin 27 is interlocked with a retaining device 60 which is associated with platen arm 50, as depicted in FIG. 4. Specifically, a link 61 brings set pin 27 in contact with a spring 61*b* which spring is mounted on a spring shaft 61*a* which is in turn attached to inner frame 12. Spring 61*b* urges link 61 toward the front—that is to the left in FIG. 4. Thus, spring 61*b* urges pin 27 toward the left end of guide slot 28.

A coupling pin 62 serves to attach a hook 63 to the end of link 61. Hook 63 is pivotable about a shaft 64 and is provided with a tip in the form of an engaging portion 63*a* which is suitable for engaging and disengaging with an engaging projection 56 which is formed on platen arm 50, as better seen in FIG. 6. A spring shaft 65*a* which is secured to inner frame 12 supports a spring 65*b*. One end of spring 65*b* fits against link 61 and the other end thereof abuts against the spring stops 24. Link 61 is thereby urged in a counterclockwise direction and thus facilitates opening of platen arm 50.

Inner frame 12 supports, in addition, a backing-sheet roller arm 66 which is designed to urge traction roller 71 against pressure roller 83 of bottom cover 80. Roller arm 66 is mounted pivotably on fulcrum shaft 67 and is provided with a housing portion 68 in which there is located a spring 69 which abuts against a step portion 12*a* on inner frame 12. Consequently, the entire roller arm 66 is urged to rotate in a clockwise direction.

Traction roller 71, which is located on the lower part of roller arm 66, is therefore urged in a counterclockwise direction. As a result, the backing sheet 97, which is guided between traction roller 71 and pressure roller 83, is caused to be paid out from the rear of the main unit. Simultaneously, any slip which may develop between the fast moving traction roller 71 and the backing sheet 97 is taken up by the action of spring 69 which is provided in roller arm 66. As shown in FIGS. 3B and 6, a screw driver access hole 57 is provided in platen arm 50. Access hole 57 is positioned so that it is in alignment with the fixing screw 40 of thermal printing device 30, when platen arm 50 is in its inclined open position.

One side of platen arm 50 is provided with an engaging projection 56 which serves to engage an engaging portion 63*a* of hook 63.

The bottom cover 80, as may been seen in FIGS. 3A, 6 and 7, is provided at its rear with a rear cutter 87 for cutting sections of backing sheet 97 which emerge from the rear of the main unit. A front cutter 88, located toward the front of bottom cover 80, enables a strip of thermal label roll 95 to be cut as required for the operational mode wherein the labeler is used for producing label strips.

For imprinting bar codes on thermal labels 96, the labels are loaded, during a first stage, into the main unit in the form of a continuous strip which is wound onto label roll 95 which is supported in turn on label holder 13.

A short section of the strip is pulled from the label roll 95. As best seen in FIG. 3B, loading of the label strip is substantially facilitated by opening bottom cover 80 and causing platen arm 50 to swing counterclockwise to thereby create a clear and easily accessible opening for the label roll 95. The label roll 95 is guided around bending pin 54 so that its moving path is redirected to the rear of printer-labeler unit 1.

Information is imprinted on thermal labels 96 as they pass by and between print head 36 and platen roller 51. Thereafter thermal labels 96 emerge from the main unit through the outlet 29. The backing sheet 97, unlike the thermal labels 96, is guided toward the rear where the backing sheet 97 is held and pulled by the pressure exerted thereon by roller 83 and traction roller 71. As noted, motor M rotates roller 71, causing backing sheet 97 to emerge from the rear of the main unit.

Figure 8:
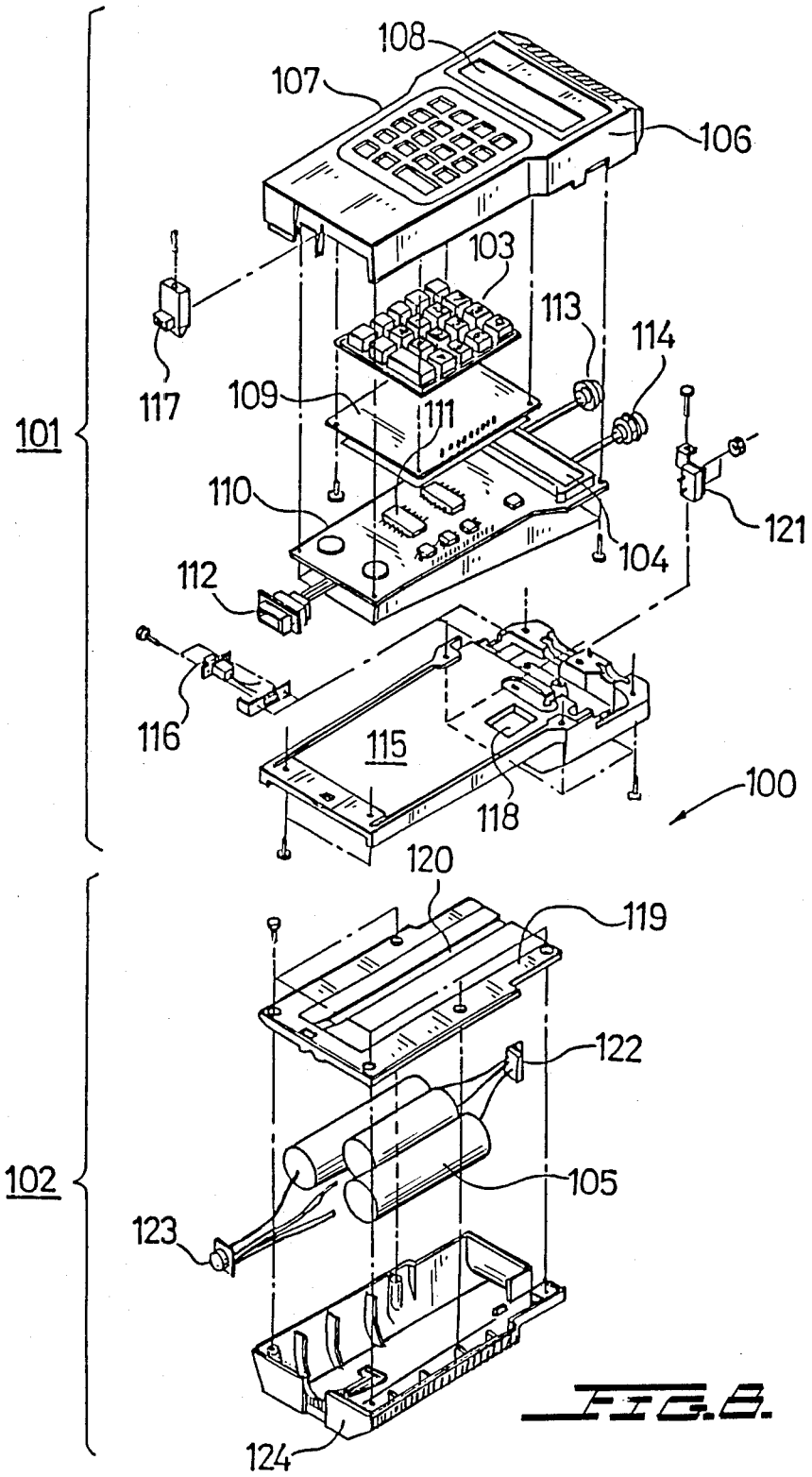
FIG. 8 is an exploded perspective view of the control unit including a keyboard, a display and batteries.

Data for printing a bar code on the labels is derived from control unit 100 seen in FIG. 8. Control unit 100 is a self contained unit, independent of printer-label unit 1, and includes in it the main keyboard 103, display 104 and batteries 105. Control unit 100 has a controller section 101 which includes the keyboard 103, the display 104 and a battery section 102 which holds batteries 105.

Controller section 101 includes a cover 106 having a keyboard face plate 107 which fits over keyboard 103 and a display window 108 which fits over display 104. An electronic component circuit board 110 includes a connector for interfacing to the keyboard 103, an electronic device board 109, display 104 and electronic devices 111. Connector 113 connects control unit 100 to the printer-label unit 1 and connector 114 provides a connection to pen scanner 4. Controller section 101 further includes a support frame 115 which is provided with a switch 116.

Battery section 102 has a battery cover 119 and a dovetail groove 120 formed thereon. Batteries 105 are coupled to connector 123, to enable the batteries to be connected to an outside power source for recharging batteries 105.

Connector 122, which is also connected to batteries 105, is electrically coupled to a plug 121 of controller section 101 to provide a path for the flow of electrical power from the batteries 105 to controller section 101. Battery section 102 has a lower cover 124.

Battery section 102 is mechanically coupled to controller section 101 by the inter-engagement of the dovetail groove 120 on the battery cover 119 and a hook member 117 provided at controller section 101. The hook member 117 is guided by the dovetail groove 120 to engage a junction opening 118, which is provided in support frame 115, and is held by battery section 102 and controller section 101 by its natural resiliency.

Reference is now made to FIGS. 2, 3A, 3B, 5 and 8 for a description of the operation of the present embodiment, involving the printing of bar codes on the thermal labels 96.

In operation, switch 116 at control unit 100 is switched to an ON position and data that is to be printed on the labels in inputted via the keys of keyboard 103. Typically, a merchandise code and a price of the merchandise or the like are keyed into control unit 100. Thereafter the number of labels that are to be printed is entered. Control unit 100 automatically generates check sum digits for the inputted data and displays the check sum digits on the display 104.

Subsequently, during a first printing stage, microswitch 22 is activated to an ON position by pressing push button 21 on printer-label unit 1. Thereupon and in accordance with electrical commands from the control section 100 certain heating elements in thermal print head 36 are caused to heat up in a manner which causes a bar code of a certain pattern to appear on the thermally sensitive thermal labels 96 which are pressed by platen roller 51 against the print head 36.

Motor M is energized to cause platen roller 51 to rotate by a given amount to advance thermal label roll 95 on platen roller 51 by a set distance. At the same time, traction roller 71 is similarly rotated via the action of belt 47 and gear wheels 48 and 49.

The movement of thermal label roll 95 causes thermal labels 96 to peel from thermal label roll 95 at backing sheet bending pin 54. The activation of motor M, platen rollers 51 and traction roller 71 is repeated until all the information on one label is imprinted thereon.

Following completion of the printing of one label, thermal label roll 95 advances further until a sensing mark (not shown) which is located on the back side of the strip-shaped backing sheet 97 is detected by a sensor S.

The thermal labels 96 are thus sequentially conveyed past print head 36 and are then peeled from the strip-shaped backing sheet at sheet bending pin 54. They are then guided out from the labeler unit 1 via an outlet 29. The peeled labels are temporarily held by a label application section 90.

The labels move below a label applicator 91 and rest on an auxiliary peeling pin 81. An operator carrying the printer-labeler unit 1 by its grip 20 is able, by sliding the label applicator roller 91 across the surface of an article, to apply the thermal label on which the printed bar code has been formed to the article.

The labeler unit senses when a preset number of labels have been produced and thereafter causes the electrical and mechanical operations of the labeler unit 1 to cease.

The foregoing description refers to the mode where the labels are delivered one by one in a peeled state from the labeler unit. Where the labels are to be delivered in a state of being still attached to the backing sheet 97, the backing sheet is threaded in the labeler such that it is not bent at bending pin 54. Instead, the backing sheet is guided over passage surface 19 and brought to outlet 29 from platen roller 51. Platen arm 50 and bottom cover 80 are then closed.

The printing operation for this operational mode of the labeler, which involves delivery of the labels on the backing sheet, proceeds by pushing push button 21 on printer-labeler 1 to start rotation of motor M to cause platen roller 51 to rotate via the associated gear wheels substantially as set forth above.

The labeler of the present invention is also provided with computer-like on-line capabilities. Connector 112 of control unit 100 may be connected to a personal computer and data from the personal computer itself or from the semiconductor or disk memory of the personal computer may be communicated to the printer-labeler unit 1 for specifying the type and particulars of the information that is to appear on the thermal labels. Data may also be entered to printer-labeler unit 1 via pen scanner 4.

The various means for cutting the label strip will now be described with reference to FIGS. 3 and 7. Labels are fed out through the front of printer-labeler unit 1 either as a continuous strip of labels which are adhered to their backing sheet or as individual peeled labels. In the mode in which peeled labels are provided, the roll of thermal label roll 95 is imprinted with required information at print head 36 and driven by platen roller 51 toward bending pin 54. There thermal labels 96 are separated from backing sheet 97 as a result of the sharp bend which is provided in backing sheet 97 at that location. Backing sheet 97 is guided by means of guide roller 82 and is pulled out of the main unit by the traction force of roller 71 and pressure roller 83.

After a given length of backing sheet 97 has emerged from the rear of the main unit of the labeler that excess backing sheet is cut off with cutter 87 which is located toward the rear on bottom cover 80.

In the second mode of operation which requires the labels to remain adhered to the backing sheet and to issue through the front of the labeler as a label strip, the label strip is cut off with front cutter 88 which is disposed at a front region on bottom cover 80. Thus, bottom cover 80 which is provided with both a rear cutter 87 and a front cutter 88 provides greater versatility and convenience in operation.

Figure 9:
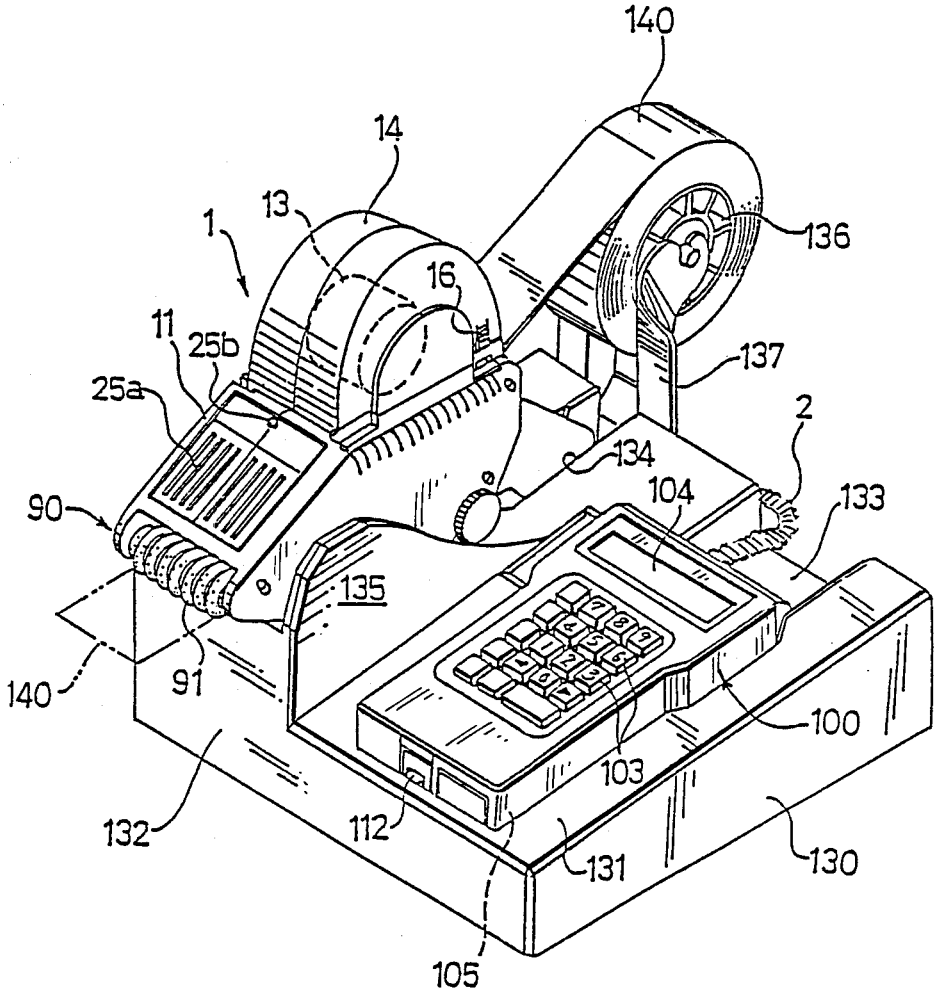
FIG. 9 is a perspective view of a label/tag printing apparatus and a stand therefor according to a second embodiment of a portable labeler according to the present invention.

A second embodiment of the hand held labeler of the present invention will now be described with reference to FIGS. 3A, 3B and 9. Although the electronic hand labeler of the present invention is usually employed for printing thermal labels, it is constructed in a manner which allows its use for printing thermal tag strips. As illustrated in FIG. 9, a continuous strip of thermal tags is wound onto a roll 140. Control unit 100 having its keyboard 103, display 104 and batteries 105 and the printer-labeler unit 1 is set on a stand 130.

Stand 130 is provided with a control unit channel 133, which is disposed on a control unit side 131 of stand 130, on which control unit 100 is located. A printer-labeler channel 134 on a printer-labeler side 132 of the stand 130 is provided for holding printer-labeler unit 1. Control unit side 131 of stand 130 is formed with a low-set incline to provide easy access to the operational component and keys of control unit 100. The other side of stand 130 which is designed to hold printer-labeler unit 1 is arranged to lie parallel to outlet 29 of the printer-labeler unit and further incorporates an anti-vibration baffle 135.

At a location thereof which faces the rear of printer-labeler unit 1, stand 130 includes a tag reel 136 which is rotatably supported on a rear support upright 137. The free end of a thermal tag strip which is supported on roll 140 faces an opening 18 which is formed on label case 14. Opening 18 is accessible to the thermal tag strip even when label case 14 is closed. The thermal tag strip can then be easily loaded as follows. With bottom cover 80 and platen arm 50 in their opened state, the leading end of the thermal tag strip is inserted in the opening 18. It is guided over label guide passage surface 19 toward label guide passage surface 78 of platen arm 50, substantially along a straight line.

Platen arm 50 and bottom cover 80 are then closed so that the leading end of thermal tag roll 140 extends along a straight line toward outlet 29, in a manner similar to the feeding of the continuous strips of labels. During the foregoing mode of operation, printer-labeler unit 1 is positioned in its printer-labeler channel 134 on stand 130. With the roll 140 wound into printer-labeler unit 1, the keys of keyboard 103 on control unit 100 are operated to input data that will be imprinted on the thermal tag strip. To this end, push button 21 of printer-labeler unit 1 is pressed to begin the printing operation and to feed the tag strip toward outlet 29, substantially as previously described.

The printer-labeler unit 1 and control unit 100 are securely and stably held on the stand 130 to provide comfortable operation of the keyboard of control unit 100 and to facilitate issuance of the tag strips from the main unit. This concludes the description of the hand held labeler version of the present application.

The desktop label printer according to the present invention is described below by reference to FIGS. 10–13.

The desktop thermal printer 201 comprises a main unit 202 having a horizontal top surface 203, a bottom surface 204, an inclined top surface 205, a front surface 206 and left and right side surfaces 207. Horizontal top surface 203 is provided with a keyboard 208 having a number of keys for data entry, while a portion of inclined top surface 205 located adjacent to horizontal top surface 203 is provided with a display 209, on which useful data is displayed. A pair of start buttons 210 (one is shown), one on each of the side surfaces 207, are provided at positions below horizontal top surface 203 and an open/close button 211 is positioned on one of side surfaces 207 at the upper portion thereof. Front surface 206 includes a cover 212 for enclosing an opening into a compartment for battery 234 and furthermore defines an outlet 213 through which a backing sheet S passes out of main unit 202. A cutter 214 is positioned at the upper edge of outlet 213.

Figure 11:
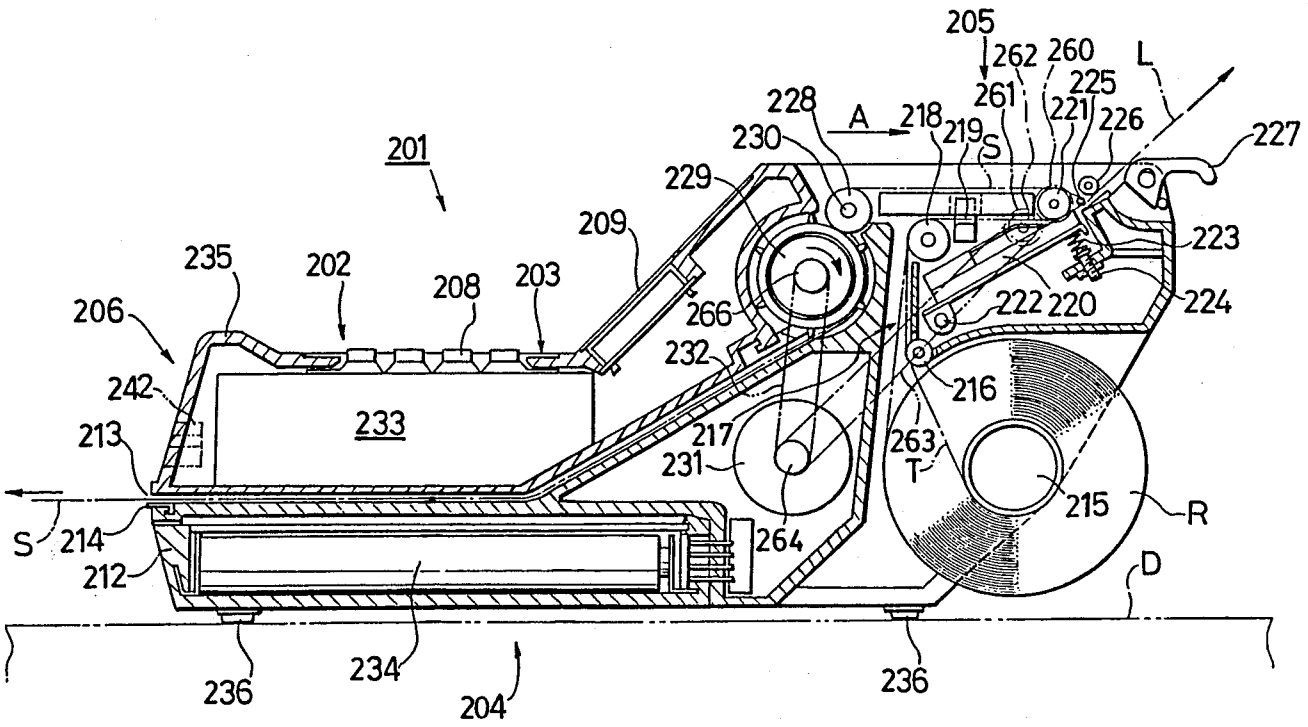
FIG. 11 is a sectional side view of the embodiment of FIG. 10.
Figure 12:
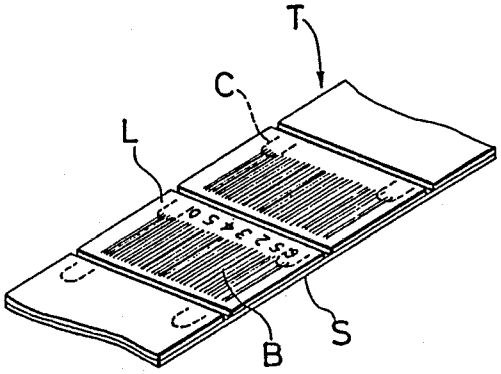
FIG. 12 is a perspective view of a segment of the label strip.

As can be seen from FIG. 11, which illustrates the internal structure of thermal printer 201, a retaining member 215 for retaining a roll R of label strip T is positioned below inclined top surface 205. Label strip T passes from roll R into a label strip guide path or passage 217, and is guided by guide roller 216. As shown in FIG. 12, label strip T consists of a backing sheet S on which are located a plurality of thermosensitive labels L. Each of the labels L has an adhesive back surface by which it is detachably adhered to label strip S. The labels follow one another along the length of the backing sheet.

Label strip T passes over a guide roller 218, then passes a label sensor 219 and thereafter is engaged between a thermal printing head 220 and a platen roller 221. At the thermal printing head 220 the label L is printed with characters, marks or the like which, depending on the data input from keyboard 208, may form a bar code B as shown in FIG. 12. Thermal printing head 220 is pivotably supported on pin 222 and it is so arranged that the pressure of the head can be adjusted by means of spring 223 and screw 224.

In one mode of operation, after printing of a label L is completed, the path of backing sheet S bends sharply at sheet bending pin 225. The sharp bending causes label L to be peeled from backing sheet S by a combination of this sharp bending action assisted by the action of an auxiliary peeling roller 226. The peeled label L is then fed out of main unit 202 and comes to rest on a label receiving cushion 227. Backing sheet S proceeds over guide roller 228 and is engaged by sheet drive roller 229 by which it is discharged outside of main unit 202 through outlet 213. The length of backing sheet S that has passed out of main unit 202 can be conveniently cut off by cutter 214.

When a new roll R of label strip T is to be loaded in main unit 202, button 211 is operated to allow a portion which includes platen roller 221 to swing upwardly about a pin 230, making it possible to insert a new roll R.

Figure 13:
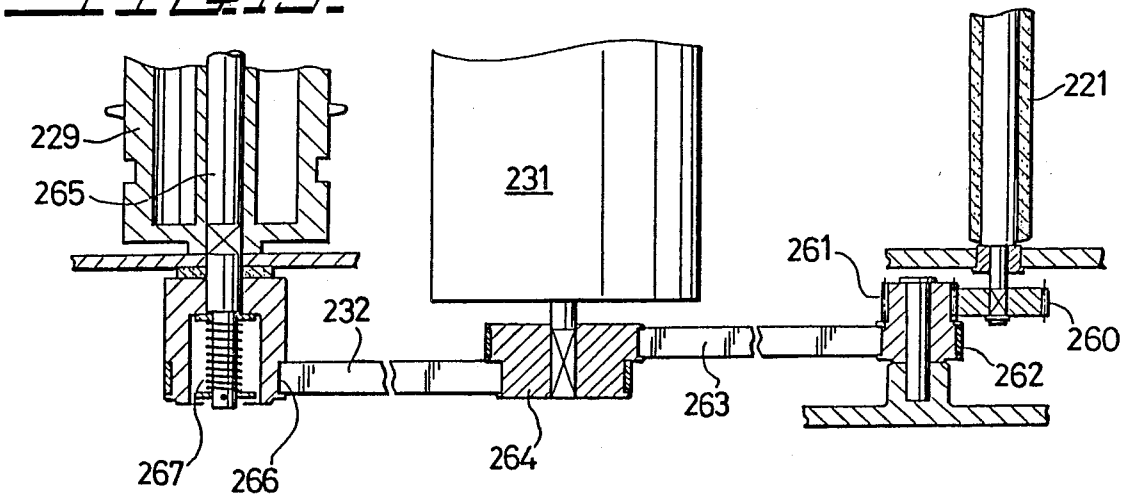
FIG. 13 is a sectional side view of an important part of the desktop labeler embodiment illustrated in FIGS. 10 and 11.

As shown in FIG. 13, platen roller 221 is linked with stepping motor 231 through plunger gear 260, an idle gear 261, an idle pulley 262, timing belt 263 and driving pulley 264, while sheet drive roller 229 is linked with stepping motor 231 through a shaft 265, gear 266, slip mechanism 267 and timing belt 232. Stepped rotation of stepping motor 231, in response to driving pulses, is transmitted to platen roller 221 and sheet drive roller 229, causing them to rotate as indicated by the arrow in FIG. 11.

Control circuit 233 is located inside main unit 202, at a position beneath keyboard 208. Control circuit 233 is electrically connected by means not illustrated in the figures to label sensor 219, thermal printing head 220, stepping motor 231, keyboard 208, display 209, start buttons 210 and battery 234 which is housed in a compartment located under control circuit 233.

Figure 10:
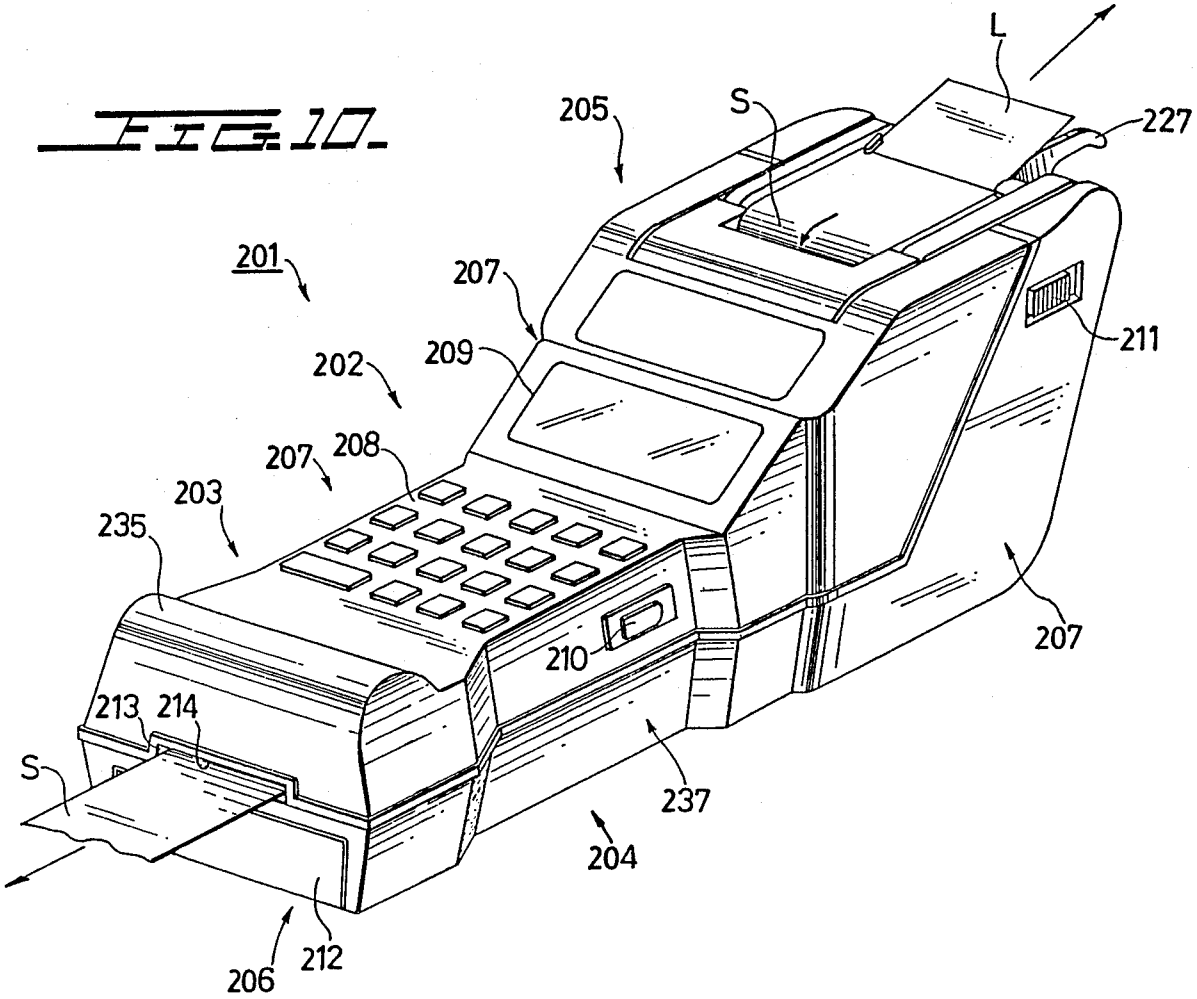
FIG. 10 is a perspective view of the desktop thermal printer according to the present invention.

The horizontal top surface 203 of main unit 202 is provided with a key guard 235, and bottom surface 204 includes two pairs of legs 236 (only one pair shown) for supporting thermal printer 201 on any available flat surface D. As shown in FIG. 10, side surfaces 207 are respectively provided with recessed portions 237 (only one shown) for making it easier to hold the thermal printer 201 in one hand while operating the keys of the keyboard 208 with the other. Further, as shown in FIG. 12, the backing sheet S of the label strip T is provided with cuts C for engagement by sheet drive roller 229.

The operation of the thermal printer will now be explained. Printer 201 can be placed on any flat surface D during operation. It can be easily transported by hand from one location to another, enabling the printing of labels at any convenient place.

When the thermal printer 201 is operated in a first mode during which the labels are separated from the backing sheet S one at a time, backing sheet S alone is sharply bent and redirected at sheet bending pin 225, thus causing the labels L to peel off backing sheet S.

In this mode of operation, when roll R containing label strip T is loaded into thermal printer 201, label backing sheet S is inserted between guide roller 228 and sheet drive roller 229. Thus, any slack of backing sheet S between sheet bending pin 225 and sheet drive roller 229 is taken up by rotation of sheet drive roller 229. Since gear 266 associated with sheet drive roller 229 is provided with slip mechanism 267, backing sheet S is thereafter fed toward outlet 213 by slipping rotation of sheet drive roller 229.

It is to be noted that the mechanism which includes sheet drive roller 229 and its slip mechanism 267 and the manner in which these elements are connected to stepping motor 231 are such that the drive roller 229 feeds the backing sheet faster than the speed with which platen roller 221 would feed the label strip. Therefore, when the label strip is initially loaded into the device, for the mode whereby the labels are separated from the backing sheet, the leading end of the backing sheet is fed faster than the trailing end thereof and any slack in the ribbon is taken up due to this effect. In operation the label strip is pinched between the thermal printing head 220 and the platen roller 221. Consequently, the faster moving sheet drive roller 229 and the slip mechanism 267 assure that the section of the backing sheet between drive roller 229 and the printing head is taut. This assures that separation of the labels from the backing sheet will take place in a very reliable manner. As previously noted the feeding of the backing sheet via the sheet drive roller 229 is optional. Hence, the desktop thermal printer according to the present invention enables ready switching from a label separating mode to a label non-separating mode and vice versa.

To operate the printer, the operator presses the keys of keyboard 208 to input the desired data. The data appears on display 209 and its accuracy can therefore be easily verified. Next, one of start buttons 210 is depressed causing stepping motor 231 to rotate sheet drive roller 229 to advance label strip T, by one label. At the same time thermal printing head 220 prints one of labels L with a bar code B or any other desired pattern or characters.

After the printing operation, backing sheet S which bears the printed label L is bent around sheet bending pin 225 causing label L to be peeled off backing sheet S and to be deposited onto label receiving cushion 227. The operator can then remove the peeled-off label L from main unit 202 with his fingers and affix it on an object (not shown) for example, a merchandise item or a parcel to be delivered or the like. The printed label can be used for data administration. Alternatively, the object receiving the label may be drawn across the top of the thermal printer in the direction indicated by arrow A whereupon label L will be directly affixed thereupon.

When thermal printer 201 is to be operated in the second mode in which the labels are not separated from backing sheet S and are instead fed out from inclined top surface 205 on backing sheet S, it is sufficient to thread label strip T so that backing sheet S is not bent back by sheet bending pin. Instead it is drawn together with labels L in the direction of label receiving cushion 227. In this case, label strip T retained between platen roller 221 and thermal printing head 220 is pulled by rotation transmitted to platen roller 221 by stepping motor 231.

Thermal printer 201, rather than being placed on the flat surface D, can also be operated while being held by hand. In this case, the operator grasps the thermal printer at recessed portions 237 with, for example, his or her left hand and operates the keys of keyboard 208 with his or her right hand.

For stability on a flat surface, legs 236 located under the printer can have suctions cups or the like.

Although the invention has been described to include a keyboard for data input, other arrangements are also possible. For example, as shown by a phantom line in FIG. 11, it is possible to provide an input terminal 242 which is connected to control circuit 233. Input terminal 242 will receive data directly from a master device or a central computer and direct it to control circuit 233, whereby thermal printer 201 can be a computer-controlled device. Alternatively, a reader, e.g., a pen reader, can be connected to input terminal 242 and data may be obtained by reading OCR characters, bar codes or the like and then input to control circuit 233. Moreover, control circuit 233 may comprise a ROM (read only memory) in which a control program and/or various data are stored. In this case, the control program and data can be easily changed by simple ROM replacement.

Although in the above embodiment stepping motor 231 and sheet drive roller 229 comprise two distinct components, it is alternatively possible to incorporate stepping motor 231 into sheet drive roller 229 and to drive platen roller 221 from roller 229 via timing belt 263 or the like. In this case, it is necessary to couple slip mechanism 267 to platen roller 221 instead of sheet drive roller 229, or to provide a drive switching mechanism such as a change-over lever for making and breaking the connection between the power source and platen roller 221. In the latter case, label strip T is first moved out by platen roller 221 and then, while platen roller 221 is disconnected from the power source by means of the drive switching mechanism, backing sheet S is conveyed by sheet drive roller 229. Next, after the slack in backing sheet S has been taken up, platen roller 221 is again connected to the drive source.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A labeler, comprising:

a hand holdable labeler housing which defines an interior for supporting a label printing mechanism therein;

an openable bottom cover mounted to the labeler housing, the bottom cover being openable to provide access to the interior and being movable between an open position and a closed position;

a thermal print head supported in the labeler housing for printing information on labels which are conveyed through the labeler;

means for guiding a backing sheet, to which the labels are detachably attached, past the print head;

a first cutter, located on the bottom cover in a first location thereon to cut sections of the backing sheet which emerge from the labeler during a first mode of operation of the labeler; and a second cutter, located on the bottom cover in a second location thereon, the second cutter being effective to enable cutting a leading section of the backing sheet from which the printed labels have been peeled off and which leading section emerges from the labeler adjacent to the second cutter, during a second mode of operation of the labeler.

2. A labeler as in claim 1, further including:

a bending pin; and pulling means disposed adjacent the second cutter for pulling the leading section of the backing sheet.

3. A labeler as in claim 2, further including:

a rotatable platen roller, located adjacent the print head, for engaging the backing sheet and conveying the backing sheet past the print head;

means for rotating the platen roller at a predetermined speed; and means for driving the pulling means faster than the platen roller in a manner which is effective to assure that no slack develops in the backing sheet between the bending pin and the pulling means whereby the labels may be separated from the backing sheet in a reliable manner.

4. A labeler as in claim 3, further including:

a platen arm which is pivotably mounted in the interior of the labeler and which is disposed generally between the bottom cover and the print head, the platen arm being pivotable between a closed position and an open position thereof, the platen roller being supported on the platen arm and being so disposed thereon that in the closed position of the platen arm the platen roller abuts the print head and in the open position of the platen arm the platen roller is offset from the print head.

5. A labeler as in claim 4, further including a label retainer member and a guide surface over which the backing sheet is slidable toward the print head, the label retainer member extending along the guide surface and the backing sheet and the labels thereon being guided between the guide surface and the label retainer member.

6. A labeler as in claim 5, further including means for coupling the platen arm to the label retainer member, the coupling means being so constructed that moving the platen arm from its closed position to its open position causes the retainer member to disengage itself from the guide surface and to create a straight label threading passage which is relatively substantially larger than the cross sectional size of the backing sheet to facilitate threading the backing sheet through the labeler.

7. A labeler as in claim 6, in which the means for coupling the platen arm to the label retainer member comprises a slot in the label retainer member, a coupling pin in the slot and a coupling portion disposed on the platen arm and attached to the coupling pin; the slot, the coupling pin and the coupling portion being so disposed relative to each other that the movement of the platen arm from its closed to its open position causes the pin to slide in the slot and to pivot the label retainer member away from the guide surface.

8. A labeler as in claim 7, in which the label retainer member includes a respective pivot about which the label retainer member is pivotable and a guide roller which is disposed on the label retainer member longitudinally oppositely to the pivot.

9. A labeler as in claim 1, further including a set pin for holding the bottom cover in its closed position, a set pin guide slot through which the set pin is movable, a link member coupled to the set pin and a hook means coupled to the link member and engagable with the platen arm to secure the platen arm in its closed position whereby the set pin is effective for releasing the hook means to cause the bottom cover and the platen arm to move simultaneously to their respective open positions.

10. A labeler as in claim 9, further including a spring for urging the platen arm toward its open position when the platen arm is disengaged from the hook means.

11. A labeler as in claim 1, in which the labeler is a hand held labeler which is operable while being held in one hand of an operator.

12. A labeler as in claim 1, in combination with a self contained, hand holdable, controller including:

a keyboard for entering information that is to be imprinted on the labels into the controller unit and a cable for connecting the controller unit to the labeler unit to enable the information which is to be imprinted on the labels to be transmitted to the labeler unit.

13. A labeling system as in claim 12, further including a stand having a first channel defined therein for supporting the labeler unit in an upright position and a second channel for supporting the control unit, the labeler unit further including a label roll support means on which a roll of labels may be supported and an opening in the label support means through which an external supply of labels may be threaded into the labeler unit.

14. A labeling system as in claim 13, further including a rear support upright which is effective for supporting thereon an external reel of tags, the rear support upright being disposed to face the opening in the label support means so that a tag strip which may be mounted on the rear support upright is capable of being threaded from the upright through the opening and into the labeler unit.

15. A labeling system as in claim 14, in which the second channel which holds the control unit has a low profile along one side thereof for providing unobstructed access to the keyboard.

16. A labeling system as in claim 15, in which the stand supports the labeler unit in a manner such that the stand does not interfere with the application of labels issuing from the labeler unit to articles to which the labels are to be attached.

* * * * *